US008617780B2

(12) United States Patent
Gong et al.

(10) Patent No.: US 8,617,780 B2
(45) Date of Patent: Dec. 31, 2013

(54) TONER HAVING TITANIA AND PROCESSES THEREOF

(75) Inventors: Yi Xin Gong, Mississauga (CA); Daryl W. Vanbesien, Burlington (CA); Shigang Qiu, Toronto (CA); Edward Graham Zwartz, Mississauga (CA); Karen Ann Moffat, Brantford (CA); Richard P. N. Veregin, Mississauga (CA); Cuong Vong, Hamilton (CA); C. Geoffrey Allen, Waterdown (CA)

(73) Assignee: Xerox Corporation, Norwalk, CT (US)

( * ) Notice: Subject to any disclaimer, the term of this patent is extended or adjusted under 35 U.S.C. 154(b) by 536 days.

(21) Appl. No.: 12/546,833

(22) Filed: Aug. 25, 2009

(65) Prior Publication Data

US 2011/0052882 A1 Mar. 3, 2011

(51) Int. Cl.
*G03G 9/00* (2006.01)

(52) U.S. Cl.
USPC ..... 430/108.6; 430/108.3; 430/108.4; 430/109.1

(58) Field of Classification Search
USPC ..... 430/108.3, 108.6, 108.4, 109.1
See application file for complete search history.

(56) References Cited

U.S. PATENT DOCUMENTS

| | | | |
|---|---|---|---|
| 3,590,000 | A | 6/1971 | Palermiti et al. |
| 3,800,588 | A | 4/1974 | Larson et al. |
| 3,847,604 | A | 11/1974 | Hagenbach et al. |
| 4,295,990 | A | 10/1981 | Verbeek et al. |
| 4,298,672 | A | 11/1981 | Lu |
| 4,338,390 | A | 7/1982 | Lu |
| 4,935,326 | A | 6/1990 | Creatura et al. |
| 4,937,166 | A | 6/1990 | Creatura et al. |
| 4,943,506 | A | 7/1990 | Demizu et al. |
| 5,236,629 | A | 8/1993 | Mahabadi et al. |
| 5,290,654 | A | 3/1994 | Sacripante et al. |
| 5,302,486 | A | 4/1994 | Patel et al. |
| 5,330,874 | A | 7/1994 | Mahabadi et al. |
| 6,063,827 | A | 5/2000 | Sacripante et al. |
| 6,114,077 | A | 9/2000 | Voets et al. |
| 6,120,967 | A | 9/2000 | Hopper et al. |
| 6,162,573 | A | 12/2000 | Grande et al. |
| 6,214,507 | B1 | 4/2001 | Sokol et al. |
| 6,593,049 | B1 | 7/2003 | Veregin et al. |
| 6,664,017 | B1 | 12/2003 | Patel et al. |
| 6,673,500 | B1 | 1/2004 | Patel et al. |
| 6,756,176 | B2 | 6/2004 | Stegamat et al. |
| 6,830,860 | B2 | 12/2004 | Sacripante et al. |
| 7,045,265 | B2 | 5/2006 | Horikoshi et al. |
| 7,052,730 | B2 | 5/2006 | Patel et al. |
| 2004/0137349 | A1 | 7/2004 | Horikoshi et al. |
| 2004/0146798 | A1 * | 7/2004 | Farrugia et al. ..... 430/137.14 |
| 2006/0222991 | A1 | 10/2006 | Sacripante et al. |
| 2007/0224532 | A1 * | 9/2007 | Vanbesien et al. ..... 430/108.22 |

FOREIGN PATENT DOCUMENTS

| | | |
|---|---|---|
| EP | 0 977 091 | 2/2000 |

OTHER PUBLICATIONS

EP Search Report for EP 10 17 3176 dated Nov. 19, 2010.

* cited by examiner

*Primary Examiner* — Thorl Chea
(74) *Attorney, Agent, or Firm* — Judith L. Byorick

(57) ABSTRACT

The present disclosure provides white toner compositions and processes for making same. In embodiments, a desirable white toner may be produced without having to resort to excessive pigment loading, having desirable gloss characteristics.

19 Claims, 7 Drawing Sheets

TONER HAVING TITANIA AND PROCESSES THEREOF

BACKGROUND

The present disclosure is generally directed to toner compositions, and more specifically, to white toner compositions and processes for making same. The white toners of the present disclosure have desirable characteristics, including gloss.

Electrophotographic printing utilizes toner particles which may be produced by a variety of processes. One such process includes an emulsion aggregation ("EA") process that forms toner particles in which surfactants are used in forming a latex emulsion. See, for example, U.S. Pat. No. 6,120,967, the disclosure of which is hereby incorporated by reference in its entirety, as one example of such a process.

Combinations of amorphous and crystalline polyesters may be used in the EA process. This resin combination provides toners with high gloss and relatively low-melting point characteristics (sometimes referred to as low-melt, ultra low melt, or ULM), which allows for more energy efficient and faster printing. The use of additives with EA toner particles may be important in realizing optimal toner performance, especially in the area of charging, where crystalline polyesters on the particle surface can lead to poor A-zone charge.

There is a continual need for improving the formation of colored EA ULM toners, including white toners.

SUMMARY

The present disclosure provides toners and processes for making same. In embodiments a toner of the present disclosure may include at least one resin; and at least one colorant including an aluminum treated titanium dioxide that has been subjected to an organic treatment, wherein the toner comprises a white toner having a gloss of from about 15 ggu to about 70 ggu.

In embodiments, the present disclosure provides a white toner including at least one polyester resin; at least one colorant including an organically treated rutile titanium dioxide that has been subjected to an organic treatment, as well as a further treatment with silica and alumina, wherein the silica is present in an amount from about 1 to about 4 percent by weight of the colorant and the titanium dioxide is present in an amount from about 90 to about 99.9 percent by weight of the colorant, and wherein the toner has a gloss of from about 15 ggu to about 70 ggu.

BRIEF DESCRIPTION OF THE DRAWINGS

Various embodiments of the present disclosure will be described herein below with reference to the figures wherein.

DETAILED DESCRIPTION

Figure 1A:
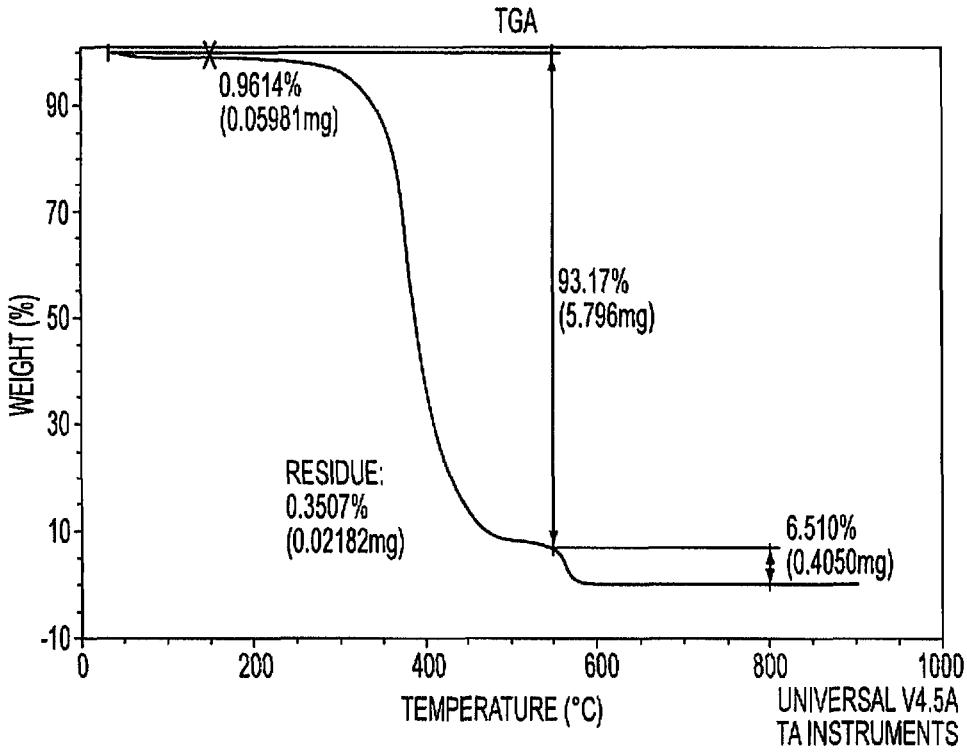
FIG. 1A is a graph showing the results of a thermogravimetric analysis of a toner of Example 2 of the present disclosure as a function of weight versus time.

The present disclosure provides chemical process to incorporate pigments, including white pigments such as titanium dioxide, into an EA ULM toner.

Toner Resins

Any latex resin may be utilized in forming a toner of the present disclosure. Such resins, in turn, may be made of any suitable monomer. Any monomer employed may be selected depending upon the particular polymer to be utilized.

In embodiments, the resin may be an amorphous resin, a crystalline resin, and/or a combination thereof. In further embodiments, the polymer utilized to form the resin may be a polyester resin, including the resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

In embodiments, the resin may be a polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol may be, for example, selected in an amount of from about 40 to about 60 mole percent, in embodiments from about 42 to about 55 mole percent, in embodiments from about 45 to about 53 mole percent (although amounts outside of these ranges can be used), and the alkali sulfo-aliphatic diol can be selected in an amount of from about 0 to about 10 mole percent, in embodiments from about 1 to about 4 mole percent of the resin (although amounts outside of these ranges can be used).

Examples of organic diacids or diesters including vinyl diacids or vinyl diesters selected for the preparation of the crystalline resins include oxalic acid, succinic acid, glutaric acid, adipic acid, suberic acid, azelaic acid, sebacic acid, fumaric acid, dimethyl fumarate, dimethyl itaconate, cis, 1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio, lithio or potassio salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid may be selected in an amount of, for example, in embodiments from about 40 to about 60 mole percent, in embodiments from about 42 to about 52 mole percent, in embodiments from about 45 to about 50 mole percent (although amounts outside of these ranges can be used), and the alkali sulfo-aliphatic diacid can be selected in an amount of from about 1 to about 10 mole percent of the resin (although amounts outside of these ranges can be used).

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), alkali copoly(5-sulfoisophthaloyl)-copoly(ethylene-adipate), alkali copoly(5-sulfoisophthaloyl)-copoly(propylene-adipate), alkali copoly(5-sulfoisophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfoisophthaloyl)-copoly(ethylene-succinate), alkali copoly(5-sulfoisophthaloyl)-copoly(propylene-succinate), alkali copoly(5-sulfoisophthaloyl)-copoly(butylenes-succinate), alkali copoly(5-sulfoisophthaloyl)-copoly(pentylene-succinate), alkali copoly(5-sulfoisophthaloyl)-copoly(hexylene-succinate), alkali copoly(5-sulfoisophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), poly(octylene-adipate), wherein alkali is a metal like sodium, lithium or potassium. Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinimide), and poly(propylene-sebecamide). Examples of polyimides include poly(ethylene-adipimide), poly(propylene-adipimide), poly(butylene-adipimide), poly(pentylene-adipimide), poly(hexylene-adipimide), poly(octylene-adipimide), poly(ethylene-succinimide), poly(propylene-succinimide), and poly(butylene-succinimide).

The crystalline resin may be present, for example, in an amount of from about 5 to about 50 percent by weight of the toner components, in embodiments from about 10 to about 35 percent by weight of the toner components (although amounts outside of these ranges can be used). The crystalline resin can possess various melting points of, for example, from about 30° C. to about 120° C., in embodiments from about 50° C. to about 90° C. (although melting points outside of these ranges can be obtained). The crystalline resin may have a number average molecular weight ($M_n$), as measured by gel permeation chromatography (GPC) of, for example, from about 1,000 to about 50,000, in embodiments from about 2,000 to about 25,000 (although number average molecular weights outside of these ranges can be obtained), and a weight average molecular weight ($M_w$) of, for example, from about 2,000 to about 100,000, in embodiments from about 3,000 to about 80,000 (although weight average molecular weights outside of these ranges can be obtained), as determined by Gel Permeation Chromatography using polystyrene standards. The molecular weight distribution ($M_w/M_n$) of the crystalline resin may be, for example, from about 2 to about 6, in embodiments from about 3 to about 4 (although molecular weight distributions outside of these ranges can be obtained).

Examples of diacids or diesters including vinyl diacids or vinyl diesters utilized for the preparation of amorphous polyesters include dicarboxylic acids or diesters such as terephthalic acid, phthalic acid, isophthalic acid, fumaric acid, dimethyl fumarate, dimethyl itaconate, cis, 1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecane diacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 52 mole percent of the resin, in embodiments from about 45 to about 50 mole percent of the resin (although amounts outside of these ranges can be used).

Examples of diols which may be utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl)oxide, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin (although amounts outside of these ranges can be used).

Polycondensation catalysts which may be utilized in forming either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin (although amounts outside of this range can be used).

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly(propylene-butylene-terephthalate)-copoly(propylene-butylene-5-sulfo-isophthalate), copoly propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), wherein the alkali metal is, for example, a sodium, lithium or potassium ion.

In embodiments, as noted above, an unsaturated amorphous polyester resin may be utilized as a latex resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

In embodiments, a suitable polyester resin may be a polyalkoxylated bisphenol A-co-terephthalic acid/dodecenylsuccinic acid/trimellitic acid resin, or a polyalkoxylated bisphenol A-co-terephthalic acid/fumaric acid/dodecenylsuccinic acid resin, or a combination thereof.

Such amorphous resins may have a weight average molecular weight (Mw) of from about 10,000 to about 100,000, in embodiments from about 15,000 to about 80,000.

An example of a linear propoxylated bisphenol A fumarate resin which may be utilized as a latex resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, North Carolina, and the like.

Suitable crystalline resins which may be utilized, optionally in combination with an amorphous resin as described above, include those disclosed in U.S. Patent Application Publication No. 2006/0222991, the disclosure of which is hereby incorporated by reference in its entirety. In embodiments, a suitable crystalline resin may include a resin formed of dodecanedioic acid and 1,9-nonanediol.

Such crystalline resins may have a weight average molecular weight (Mw) of from about 10,000 to about 100,000, in embodiments from about 14,000 to about 30,000.

For example, in embodiments, a polyalkoxylated bisphenol A-co-terephthalic acid/dodecenylsuccinic acid/trimellitic acid resin, or a polyalkoxylated bisphenol A-co-terephthalic acid/fumaric acid/dodecenylsuccinic acid resin, or a combination thereof, may be combined with a polydodecanedioic acid-co-1,9-nonanediol crystalline polyester resin.

In embodiments, the resins utilized may have a glass transition temperature of from about 30° C. to about 80° C., in embodiments from about 35° C. to about 70° C. In further embodiments, the resins may have a melt viscosity of from about 10 to about 1,000,000 Pa*S at about 130° C., in embodiments from about 20 to about 100,000 Pa*S.

One, two, or more toner resins may be used. In embodiments where two or more toner resins are used, the toner resins may be in any suitable ratio (e.g., weight ratio) such as for instance about 10% (first resin)/90% (second resin) to about 90% (first resin)/10% (second resin).

In embodiments, the resin may be formed by emulsion polymerization methods.

Surfactants

In embodiments, colorants, waxes, and other additives utilized to form toner compositions may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered.

One, two, or more surfactants may be utilized. The surfactants may be selected from ionic surfactants and nonionic surfactants. In embodiments, the latex for forming the resin utilized in forming a toner may be prepared in an aqueous phase containing a surfactant or co-surfactant, optionally under an inert gas such as nitrogen. Surfactants which may be utilized with the resin to form a latex dispersion can be ionic or nonionic surfactants in an amount of from about 0.01 to about 15 weight percent of the solids, and in embodiments of from about 0.1 to about 10 weight percent of the solids.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abietic acid available from Aldrich, NEOGEN R™, NEOGEN SC™ obtained from Daiichi Kogyo Seiyaku Co., Ltd., combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of cationic surfactants include, but are not limited to, ammoniums, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, C12, C15, C17 trimethyl ammonium bromides, combinations thereof, and the like. Other cationic surfactants include cetyl pyridinium bromide, halide salts of quaternized polyoxyethylalkylamines, dodecylbenzyl triethyl ammonium chloride, MIRAPOL and ALKAQUAT available from Alkaril Chemical Company, SANISOL (benzalkonium chloride), available from Kao Chemicals, combinations thereof, and the like. In embodiments a suitable cationic surfactant includes SANISOL B-50 available from Kao Corp., which is primarily a benzyl dimethyl alkonium chloride.

Examples of nonionic surfactants include, but are not limited to, alcohols, acids and ethers, for example, polyvinyl alcohol, polyacrylic acid, methalose, methyl cellulose, ethyl cellulose, propyl cellulose, hydroxyl ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, combinations thereof, and the like. In embodiments commercially available surfactants from Rhone-Poulenc such as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™ can be utilized.

The choice of particular surfactants or combinations thereof, as well as the amounts of each to be used, are within the purview of those skilled in the art.

Colorants

Conventional color toners utilized in electrophotographic applications may include colors such as cyan, magenta, yellow and black. To obtain improved pictoral image quality, additional colors such as orange, violet, and/or green, and lighter colorants such as light cyan and/or light magenta may be included in developers for imaging systems.

To produce a truly white fused toner image, white toners with high pigment loadings of a white pigment such as titanium dioxide may be required. One problem with this technique is that it may be difficult to incorporate enough white pigment into an EA toner and produce a dense enough xerographic print that contains a white image. For example, while mixtures of white and color toners have been produced via conventional process with relatively low pigment loading (about 10% by weight), this may be an insufficient amount of pigment for overall coverage.

In accordance with the present disclosure, a chemical process may be utilized to incorporate an organically treated titanium dioxide into an ULM toner. As used herein, an organically treated titanium oxide may include, for example, a titanium dioxide that has been subjected to alumina surface treatment followed by an organic treatment resulting in an oil absorption from about 9 to about 20 pounds of oil per 100 pounds of titanium dioxide. In embodiments, the organically treated titanium oxide may be a rutile titanium oxide. Organically treated titanium dioxides may include, for example, titanium dioxide commercially available as TI-PURE® R-706, or TI-PURE® R-902+, both available from Dupont. This titanium dioxide may have a refractive index of from about 2.4 to about 3, in embodiments from about 2.5 to about 2.8, and has been found to be surprisingly compatible with the polyester resins described above utilized in forming toners of the present disclosure. The organically treated titanium dioxide also has a high color strength, and a median particle size of from about 0.12 μm to about 0.6 μm, in embodiments from about 0.2 μm to about 0.5 μm, which is excellent for aggregation and coalescence processes utilized in forming toner particles. This organically treated pigment also has a broad size distribution for light scattering (from about 130 nm to about 170 nm is optimal for blue light scattering, from about 200 nm to about 235 nm is optimal for green light scattering, and from about 240 nm to about 260 nm is optimal for red light scattering).

Further features of this organically treated titanium dioxide include excellent dispersibility within the toner, and it also has been treated with silica and alumina, which further promote good dispersibility.

Suitable organically treated titanium dioxides may include, in embodiments, the following characteristics:

- titanium dioxide in an amount of from about 60 percent by weight to about 99.9 percent by weight, in embodiments from about 80 percent by weight to about 95 percent by weight, in some embodiments at least about 93 percent by weight;
- alumina in an amount of from about 1 percent by weight to about 10 percent by weight, in embodiments from about 2 percent by weight to about 5 percent by weight, in some embodiments about 2.5 percent by weight;
- amorphous silica in an amount of from about 0 percent by weight to about 5 percent by weight, in embodiments from about 1 percent by weight to about 4 percent by weight, in some embodiments about 3 percent by weight;
- specific gravity from about 3.6 to about 4.4, in embodiments from about 3.8 to about 4.2, in some embodiments about 4;
- a lightness L* from about 95 to about 100, in embodiments from about 98 to about 99.8, in some embodiments about 99.4;
- particle size from about 120 nm to about 600 nm, in embodiments from about 200 nm to about 400 nm, in some embodiments about 360 nm;
- oil absorption from about 10 to about 25, in embodiments from about 15 to about 20, in some embodiments about 13.9 pounds of oil per 100 pounds of titanium dioxide;
- pH from about 6.5 to about 10, in embodiments from about 7 to about 9, in some embodiments about 8.2.

In embodiments, a colorant of the present disclosure may include silica present in an amount from about 1 to about 4 percent by weight of the colorant, in embodiments from about 2 to about 3 percent by weight of the colorant, with titanium dioxide present in an amount from about 90 to about 99.9 percent by weight of the colorant, in embodiments from about 92 to about 98 percent by weight of the colorant.

The amount of the organically treated titanium dioxide may be from about 5 weight percent to about 50 weight percent of the toner, in embodiments from about 10 weight percent to about 35 weight percent of the toner.

Toners of the present disclosure may possess a gloss level of from about 10 Gardner gloss units (ggu) to about 90 ggu, in embodiments from about 15 ggu to about 70 ggu. As described in greater detail below, in some embodiments the presence of an aluminum aggregating agent in the final toner may further be utilized to control the gloss levels.

In embodiments, toners of the present disclosure may be combined with other color toners in an electrophotographic apparatus to form a desired image. As additional colorants to be added to form other color toners, various known suitable colorants, such as dyes, pigments, mixtures of dyes, mixtures of pigments, mixtures of dyes and pigments, and the like, may be included in the toner. The additional colorant may be included in the toner in an amount of, for example, from about 0.1 to about 35 percent by weight of the toner, or from about 1 to about 15 weight percent of the toner, or from about 3 to about 10 percent by weight of the toner, although amounts outside these ranges may be utilized.

As examples of other suitable colorants, mention may be made of carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

Specific examples of pigments include SUNSPERSE 6000, FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing, and the like.

Wax

Optionally, a wax may also be combined with the resin and optional colorant in forming toner particles. When included, the wax may be present in an amount of, for example, from about 1 weight percent to about 25 weight percent of the toner particles, in embodiments from about 5 weight percent to about 20 weight percent of the toner particles, although amounts outside these ranges may be utilized.

Waxes that may be selected include waxes having, for example, a weight average molecular weight of from about 500 to about 20,000, in embodiments from about 1,000 to about 10,000, although molecular weights outside these ranges may be utilized. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15 ™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

Toner Preparation

The toner particles may be prepared by any method within the purview of one skilled in the art. Although embodiments relating to toner particle production are described below with respect to emulsion aggregation processes, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner particle shape and morphology.

In embodiments, toner compositions may be prepared by emulsion aggregation processes, such as a process that includes aggregating a mixture of a colorant, in embodiments a white pigment such as organically treated titanium dioxide, an optional wax and any other desired or required additives, and emulsions including the resins described above, optionally in surfactants as described above, and then coalescing the aggregate mixture. A mixture may be prepared by adding a colorant and optionally a wax or other materials, which may also be optionally in a dispersion(s) including a surfactant, to the emulsion, which may be a mixture of two or more emulsions containing the resin. The pH of the resulting mixture may be adjusted by an acid such as, for example, acetic acid, nitric acid or the like. In embodiments, the pH of the mixture may be adjusted to from about 4 to about 5, although a pH outside this range may be utilized. Additionally, in embodiments, the mixture may be homogenized. If the mixture is homogenized, homogenization may be accomplished by mixing at about 600 to about 4,000 revolutions per minute, although speeds outside this range may be utilized. Homogenization may be accomplished by any suitable means, including, for example, an IKA ULTRA TURRAX T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

As noted above, in embodiments, the aggregating agent may be an aluminum compound. The aluminum aggregating agent may remain in the toners of the present disclosure, in embodiments the white toner of the present disclosure, and the presence of the aluminum in such a toner may further contribute to obtaining the desired gloss of the white toner.

In embodiments, the aggregating agent, such as an aluminum aggregating agent, may be added to the mixture utilized to form a toner in an amount of, for example, from about 0.01% to about 8% by weight, in embodiments from about 0.1% to about 1% by weight, in other embodiments from about 0.15% to about 0.8% by weight, of the resin in the mixture, although amounts outside these ranges may be utilized. This may provide a sufficient amount of agent for aggregation.

In order to control aggregation and subsequent coalescence of the particles, in embodiments the aggregating agent may be metered into the mixture over time. For example, the agent may be metered into the mixture over a period of from about 5 to about 240 minutes, in embodiments from about 30 to about 200 minutes, although more or less time may be used as desired or required. The addition of the agent may occur while the mixture is maintained under stirred conditions, in embodiments from about 50 rpm to about 1,000 rpm, in other embodiments from about 100 rpm to about 500 rpm, although speeds outside these ranges may be utilized. The addition of the agent may also occur while the mixture is maintained at a temperature that is below the glass transition temperature of the resin discussed above, in embodiments from about 30° C. to about 90° C., in embodiments from about 35° C. to about 70° C., although temperatures outside these ranges may be utilized.

The particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size. The aggregation thus may proceed by maintaining the elevated temperature, or slowly raising the temperature to, for example, from about 30° C. to about 99° C., and holding the mixture at this temperature for a time from about 0.5 hours to about 10 hours, in embodiments from about hour 1 to about 5 hours (although times outside these ranges may be utilized), while maintaining stirring, to provide the aggregated particles. Once the predetermined desired particle size is reached, then the growth process is halted. In embodiments, the predetermined desired particle size is within the desired size of the final toner particles.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 40° C. to about 90° C., in embodiments from about 45° C. to about 80° C. (although temperatures outside these ranges may be utilized), which may be below the glass transition temperature of the resin as discussed above.

Once the desired final size of the toner particles is achieved, the pH of the mixture may be adjusted with a base to a value of from about 3 to about 10, and in embodiments from about 5 to about 9, although a pH outside these ranges may be utilized. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above.

In embodiments, after aggregation, but prior to coalescence, a resin coating may be applied to the aggregated particles to form a shell thereover. Any resin described above as suitable for forming the toner resin may be utilized as the shell.

In embodiments, resins which may be utilized to form a shell include, but are not limited to, crystalline polyesters described above, and/or the amorphous resins described above for use as the core. For example, in embodiments, a polyalkoxylated bisphenol A-co-terephthalic acid/dodecenylsuccinic acid/trimellitic acid resin, a polyalkoxylated bisphenol A-co-terephthalic acid/fumaric acid/dodecenylsuccinic acid resin, or a combination thereof, may be combined with a polydodecanedioic acid-co-1,9-nonanediol crystalline polyester resin to form a shell. Multiple resins may be utilized in any suitable amounts.

The shell resin may be applied to the aggregated particles by any method within the purview of those skilled in the art. In embodiments, the resins utilized to form the shell may be in an emulsion including any surfactant described above. The emulsion possessing the resins may be combined with the aggregated particles described above so that the shell forms over the aggregated particles. In embodiments, the shell may have a thickness of up to about 5 microns, in embodiments of from about 0.1 to about 2 microns, in other embodiments, from about 0.3 to about 0.8 microns, over the formed aggregates, although thicknesses outside of these ranges may be obtained.

The formation of the shell over the aggregated particles may occur while heating to a temperature of from about 30° C. to about 80° C., in embodiments from about 35° C. to about 70° C., although temperatures outside of these ranges may be utilized. The formation of the shell may take place for a period of time of from about 5 minutes to about 10 hours, in embodiments from about 10 minutes to about 5 hours, although times outside these ranges may be used.

For example, in some embodiments, the toner process may include forming a toner particle by mixing the polymer latexes, in the presence of a wax and a colorant dispersion, including the organically treated titanium dioxide described above, with an optional coagulant while blending at high speeds. The resulting mixture having a pH of, for example, of from about 2 to about 3, is aggregated by heating to a temperature below the polymer resin Tg to provide toner size aggregates. Optionally, additional latex can be added to the formed aggregates providing a shell over the formed aggregates. The pH of the mixture may then be changed, for example by the addition of a sodium hydroxide solution, until a pH of about 7 may be achieved.

Coalescence

Following aggregation to the desired particle size and application of any optional shell, the particles may then be coalesced to the desired final shape, the coalescence being achieved by, for example, heating the mixture to a temperature of from about 45° C. to about 100° C., in embodiments from about 55° C. to about 99° C. (although temperatures outside of these ranges may be used), which may be at or above the glass transition temperature of the resins utilized to form the toner particles, and/or reducing the stirring, for example to from about 100 rpm to about 1,000 rpm, in embodiments from about 200 rpm to about 800 rpm (although speeds outside of these ranges may be used). The fused particles can be measured for shape factor or circularity, such as with a Sysmex FPIA 2100 analyzer, until the desired shape is achieved.

Higher or lower temperatures may be used, it being understood that the temperature is a function of the resins used for the binder. Coalescence may be accomplished over a period of from about 0.01 hours to about 9 hours, in embodiments from about 0.1 hours to about 4 hours (although times outside of these ranges may be used).

After aggregation and/or coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

Additives

In embodiments, the toner particles may also contain other optional additives, as desired or required. For example, the toner may include positive or negative charge control agents, for example in an amount of from about 0.1 to about 10 percent by weight of the toner, in embodiments from about 1 to about 3 percent by weight of the toner (although amounts outside of these ranges may be used). Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; aluminum salts such as BONTRON E84™ or E88™ (Orient Chemical Industries, Ltd.); combinations thereof, and the like. Such charge control agents may be applied simultaneously with the shell resin described above or after application of the shell resin.

There can also be blended with the toner particles external additive particles after formation including flow aid additives, which additives may be present on the surface of the toner particles. Examples of these additives include metal oxides such as titanium oxide, silicon oxide, aluminum oxides, cerium oxides, tin oxide, mixtures thereof, and the like; colloidal and amorphous silicas, such as AEROSIL®, metal salts and metal salts of fatty acids inclusive of zinc stearate, calcium stearate, or long chain alcohols such as UNILIN 700, and mixtures thereof.

In general, silica may be applied to the toner surface for toner flow, tribo enhancement, admix control, improved development and transfer stability, and higher toner blocking temperature. $TiO_2$ may be applied for improved relative humidity (RH) stability, tribo control and improved development and transfer stability. Zinc stearate, calcium stearate and/or magnesium stearate may optionally also be used as an external additive for providing lubricating properties, developer conductivity, tribo enhancement, enabling higher toner charge and charge stability by increasing the number of contacts between toner and carrier particles. In embodiments, a commercially available zinc stearate known as Zinc Stearate L, obtained from Ferro Corporation, may be used. The external surface additives may be used with or without a coating.

Each of these external additives may be present in an amount of from about 0.1 percent by weight to about 5 percent by weight of the toner, in embodiments of from about 0.25 percent by weight to about 3 percent by weight of the toner, although the amount of additives can be outside of these ranges. In embodiments, the toners may include, for example, from about 0.1 weight percent to about 5 weight percent titanium dioxide, from about 0.1 weight percent to about 8 weight percent silica, and from about 0.1 weight percent to about 4 weight percent zinc stearate (although amounts outside of these ranges may be used).

Suitable additives include those disclosed in U.S. Pat. Nos. 3,590,000, 3,800,588, and 6,214,507, the disclosures of each of which are hereby incorporated by reference in their entirety. Again, these additives may be applied simultaneously with the shell resin described above or after application of the shell resin.

In embodiments, toners of the present disclosure may be utilized as ultra low melt (ULM) toners. In embodiments, the dry toner particles having a core and/or shell may, exclusive of external surface additives, have one or more the following characteristics:

(1) Volume average diameter (also referred to as "volume average particle diameter") was measured for the toner particle volume and diameter differentials. The toner particles have a volume average diameter of from about 3 to about 25 μm, in embodiments from about 4 to about 15 μm, in other embodiments from about 5 to about 12 μm (although values outside of these ranges may be obtained).

(2) Number Average Geometric Size Distribution (GSDn) and/or Volume Average Geometric Size Distribution (GSDv): In embodiments, the toner particles described in (1) above may have a very narrow particle size distribution with a lower number ratio GSD of from about 1.15 to about 1.38, in other embodiments, less than about 1.31 (although values outside of these ranges may be obtained). The toner particles of the present disclosure may also have a size such that the upper GSD by volume in the range of from about 1.20 to about 3.20, in other embodiments, from about 1.26 to about 3.11 (although values outside of these ranges may be obtained). Volume average particle diameter $D_{50v}$, GSDv, and GSDn may be measured by means of a measuring instrument such as a Beckman Coulter Multisizer 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3.

(3) Shape factor of from about 105 to about 170, in embodiments, from about 110 to about 160, SF1*a (although values outside of these ranges may be obtained). Scanning electron microscopy (SEM) may be used to determine the shape factor analysis of the toners by SEM and image analysis (IA). The average particle shapes are quantified by employing the following shape factor (SF1*a) formula: $SF1*a=100\ \pi d^2/(4A)$, where A is the area of the particle and d is its major axis. A perfectly circular or spherical particle has a shape factor of exactly 100. The shape factor SF1*a increases as the shape becomes more irregular or elongated in shape with a higher surface area.

(4) Circularity of from about 0.92 to about 0.99, in other embodiments, from about 0.94 to about 0.975 (although values outside of these ranges may be obtained). The instrument used to measure particle circularity may be an FPIA-2100 manufactured by Sysmex.

The characteristics of the toner particles may be determined by any suitable technique and apparatus and are not limited to the instruments and techniques indicated hereinabove.

In embodiments, the toner particles may have a weight average molecular weight (Mw) in the range of from about 17,000 to about 80,000 daltons, a number average molecular weight (Mn) of from about 3,000 to about 10,000 daltons, and a MWD (a ratio of the Mw to Mn of the toner particles, a measure of the polydispersity, or width, of the polymer) of from about 2.1 to about 10 (although values outside of these ranges may be obtained).

Toners produced in accordance with the present disclosure may possess excellent charging characteristics when exposed to extreme relative humidity (RH) conditions. The low-humidity zone (C zone) may be about 12° C./15% RH, while the high humidity zone (A zone) may be about 28° C./85% RH (although values outside of these ranges may be obtained). Toners of the present disclosure may possess a parent toner charge per mass ratio (Q/M) of from about −2 μC/g to about −28 μC/g, in embodiments from about −4 μC/g to about −25 μC/g (although values outside of these ranges may be obtained), and a final toner charging after surface additive blending of from −8 μC/g to about −25 μC/g, in embodiments from about −10 μC/g to about −22 μC/g (although values outside of these ranges may be obtained).

Developer

The toner particles may be formulated into a developer composition. For example, the toner particles may be mixed with carrier particles to achieve a two-component developer composition. The carrier particles can be mixed with the toner particles in various suitable combinations. The toner concentration in the developer may be from about 1% to about 25% by weight of the developer, in embodiments from about 2% to about 15% by weight of the total weight of the developer (although values outside of these ranges may be used). In embodiments, the toner concentration may be from about 90% to about 98% by weight of the carrier (although values outside of these ranges may be used). However, different toner and carrier percentages may be used to achieve a developer composition with desired characteristics.

Carriers

Illustrative examples of carrier particles that can be selected for mixing with the toner composition prepared in accordance with the present disclosure include those particles that are capable of triboelectrically obtaining a charge of opposite polarity to that of the toner particles. Accordingly, in one embodiment the carrier particles may be selected so as to be of a negative polarity in order that the toner particles that are positively charged will adhere to and surround the carrier particles. Illustrative examples of such carrier particles include granular zircon, granular silicon, glass, silicon dioxide, iron, iron alloys, steel, nickel, iron ferrites, including ferrites that incorporate strontium, magnesium, manganese, copper, zinc, and the like, magnetites, and the like. Other carriers include those disclosed in U.S. Pat. Nos. 3,847,604, 4,937,166, and 4,935,326.

The selected carrier particles can be used with or without a coating. In embodiments, the carrier particles may include a core with a coating thereover which may be formed from a mixture of polymers that are not in close proximity thereto in the triboelectric series. The coating may include polyolefins, fluoropolymers, such as polyvinylidene fluoride resins, terpolymers of styrene, acrylic and methacrylic polymers such as methyl methacrylate, acrylic and methacrylic copolymers with fluoropolymers or with monoalkyl or dialkylamines, and/or silanes, such as triethoxy silane, tetrafluoroethylenes, other known coatings and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, may be used. In embodiments, polyvinylidenefluoride and polymethylmethacrylate (PMMA) may be mixed in proportions of from about 30 weight % to about 70 weight %, in embodiments from about 40 weight % to about 60 weight % (although values outside of these ranges may be used). The coating may have a coating weight of, for example, from about 0.1 weight % to about 5% by weight of the carrier, in embodiments from about 0.5 weight % to about 2% by weight of the carrier (although values outside of these ranges may be obtained).

In embodiments, PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 weight % to about 10 weight %, in embodiments from about 0.01 weight % to about 3 weight %, based on the weight of the coated carrier particles (although values outside of these ranges may be used), until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

In embodiments, suitable carriers may include a steel core, for example of from about 25 to about 100 μm in size, in embodiments from about 50 to about 75 μm in size (although sizes outside of these ranges may be used), coated with about 0.5% to about 10% by weight, in embodiments from about 0.7% to about 5% by weight (although amounts outside of these ranges may be obtained), of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations are may be from about 1% to about 20% by weight of the toner composition (although concentrations outside of this range may be obtained). However, different toner and carrier percentages may be used to achieve a developer composition with desired characteristics.

Imaging

Toners of the present disclosure may be utilized in electrostatographic (including electrophotographic) or xerographic imaging methods, including those disclosed in, for example, U.S. Pat. No. 4,295,990, the disclosure of which is hereby incorporated by reference in its entirety. In embodiments, any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with a xerographic device including a charging component, an imaging component, a photoconductive component, a developing component, a transfer component, and a fusing component. In embodiments, the development component may include a developer prepared by mixing a carrier with a toner composition described herein. The xerographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser roll member. Fuser roll members are contact fusing devices that are within the purview of those skilled in the art, in which heat and pressure from the roll may be used to fuse the toner to the image-receiving medium. In embodiments, the fuser member may be heated to a temperature above the fusing temperature of the toner, for example to temperatures of from about 70° C. to about 160° C., in embodiments from about 80° C. to about 150° C., in other embodiments from about 90° C. to about 140° C. (although temperatures outside of these ranges may be used), after or during melting onto the image receiving substrate.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

Example 1

About 100 grams of an organically treated titanium dioxide, commercially available as TI-PURE® R-706 from Dupont, was added to about 363.9 grams of deionized water and about 36 grams of DOWFAX™ 2A1, an alkyldiphenyloxide disulfonate from The Dow Chemical Company, and agitated for about 10 minutes to form a dispersion. The solution was homogenized by mixing at a speed of about 10,000 revolutions per minute (rpm) for about 10 minutes to achieve a narrowly distributed pigment solution. The solids content of the titanium dioxide dispersion was about 21.32% by weight.

Example 2

Preparation of a white ULM toner with different levels of titanium dioxide. A glossy, clear toner was produced as follows. About 70.87 grams of a polyalkoxylated bisphenol A-co-terephthalic acid/dodecenylsuccinic acid/trimellitic acid resin from Kao in an emulsion (the resin was present in an amount of about 39.16% by weight, having a glass transition temperature of about 56° C., and particles with a size of about 207 nm) was combined with about 77.93 grams of a polyalkoxylated bisphenol A-co-terephthalic acid/fumaric acid/dodecenylsuccinic acid resin from Kao in an emulsion (the resin was present in an amount of about 35.61% by weight, having a glass transition temperature of about 60.5° C., and particles with a size of about 215 nm), about 23.79 grams of a polydodecanedioic acid-co-1,9-nonanediol crystalline polyester resin from Kao in an emulsion (the resin was present in an amount of about 31.51% by weight, having a melting temperature of about 71.04° C., and particles with a size of about 151 nm), about 2.7 grams of DOWFAX™ 2A1, about 31.11 grams of a polyethylene wax emulsion (from IGI), and about 369.194 grams of deionized water in a glass kettle and homogenized using IKA Ultra Turrax T50 homogenizer operating at about 4000 rpm for about 1 minute.

Thereafter, about 1.79 grams of $Al_2(SO_4)_3$ mixed with about 48 grams of deionized water as a flocculent was added drop-wise to the kettle and homogenized with stirring at about 4000 rpm for about 10 minutes. The mixture was degassed for about 20 minutes at about 280 rpm and then heated at a rate of about 1° C. per minute to a temperature of about 37° C., with mixing at about 460 rpm for aggregation. The particle size was monitored using a Coulter Counter until the particle size reached about 5 μm.

A shell mixture, including about 35.75 grams of the polyalkoxylated bisphenol A-co-terephthalic acid/dodecenylsuccinic acid/trimellitic acid resin from Kao in an emulsion described above, about 39.02 grams of the polyalkoxylated bisphenol A-co-terephthalic acid/fumaric acid/dodecenylsuccinic acid resin from Kao in an emulsion described above, about 1.2 grams of DOWFAX™ 2A1, and about 37 grams of deionized water, was introduced into the reaction and allowed to aggregate for about another 10 to about 20 minutes at about 40° C., with mixing at about 460 rpm. Once the volume average particle diameter was above about 5.7 μm according to the measurement with a Coulter Counter, the pH of the aggregation slurry was adjusted to about 4 by the addition of about 4% by weight of NaOH solution, followed by the addition of about 3.8 grams of ethyelene diamine tetraacetic acid (EDTA) and thereafter decreased the mixing speed to about 190 rpm to freeze the toner aggregation at a pH of about 7.5, which was maintained by the addition of about 4% by weight of the NaOH solution.

After freezing, the toner slurry was heated to coalesce. The resulting toner had a final particle size of about 5.77 μm, a GSD v/n of about 1.176/1.22, and a circularity of about 0.97. The toner slurry was then cooled to room temperature, separated by sieving (using a 25 μm sieve), and filtered, which was followed by washing and freeze drying.

Example 3

About 52 grams of the of the polyalkoxylated bisphenol A-co-terephthalic acid/dodecenylsuccinic acid/trimellitic acid resin from Kao in an emulsion described above in Example 2, about 59 grams of the polyalkoxylated bisphenol A-co-terephthalic acid/fumaric acid/dodecenylsuccinic acid resin from Kao in an emulsion described above in Example 2, about 21.58 grams of the polydodecanedioic acid-co-1,9-nonanediol crystalline polyester resin from Kao in an emulsion described above in Example 2, about 2.1 grams of DOWFAX™ 2A 1, about 73.6 grams of the titanium dioxide dispersion from Example 1 above (having an average particle size of about 306 nm, with a solids loading of about 21.86% by weight), and about 31.11 grams of a polyethylene wax emulsion (from IGI), were added to about 334 grams of deionized water in a glass kettle and were homogenized using IKA Ultra Turrax T50 homogenizer operating at 4000 rpm for about 1 minutes.

Thereafter, about 1.79 grams of $Al_2(SO_4)_3$ mixed with about 48 grams of deionized water as a flocculent was added drop-wise to the kettle and homogenized for about 10 minutes with mixing at about 4000 rpm. The mixture was degassed for about 20 minutes at about 280 rpm and then was heated at a rate of about 1° C. per minute to a temperature of about 52° C. with stirring at about 360 rpm for aggregation. The particle size was monitored using a Coulter Counter until the particle size reached about 5 μm.

The shell mixture of Example 2, including about 35.75 grams of polyalkoxylated bisphenol A-co-terephthalic acid/dodecenylsuccinic acid/trimellitic acid resin from Kao in an emulsion described above, about 39.9 grams of the polyalkoxylated bisphenol A-co-terephthalic acid/fumaric acid/dodecenylsuccinic acid resin from Kao in an emulsion described above, about 1.2 grams of DOWFAX™ 2A1, and about 36 grams of deionized water, were introduced into the reaction vessel and the particles allowed to aggregate for from about another 10 minutes to about 20 minutes at about 40° C., with mixing at about 400 rpm.

Once the volume average particle diameter was above about 5.7 μm according to the measurement with a Coulter Counter, the pH of the aggregation slurry was adjusted to about 4 by the addition of about 4% by weight of NaOH solution, followed by the addition of about 3.1 grams of EDTA and thereafter decreased the mixing speed to about 190 rpm to freeze the toner aggregation at a pH of about 7.8, which was maintained by the addition of about 4% by weight of the NaOH solution.

After freezing, the toner slurry was heated to coalesce. The resulting toner had a final particle size of about 6.34 μm, a GSD v/n of about 1.23/1.23, and a circularity of about 0.98. The toner slurry was then cooled to room temperature, separated by sieving (using a 25 μm sieve), and filtered, which was followed by washing and freeze drying.

The resulting toner particles had about 15% by weight of titanium dioxide pigment.

Example 4

About 46 grams of the of the polyalkoxylated bisphenol A-co-terephthalic acid/dodecenylsuccinic acid/trimellitic acid resin from Kao in an emulsion described above in Example 2, about 51.6 grams of the polyalkoxylated bisphenol A-co-terephthalic acid/fumaric acid/dodecenylsuccinic acid resin from Kao in an emulsion described above in Example 2, about 21.58 grams of the polydodecanedioic acid-co-1,9-nonanediol crystalline polyester resin from Kao in an emulsion described above in Example 2, about 1.84 grams of DOWFAX™ 2A1, about 98 grams of the titanium dioxide dispersion from Example 1 above (having an average particle size of about 306 nm, with a solids loading of about 21.86% by weight), and about 31.11 grams of a polyethylene wax emulsion (from IGI), were added to about 334 grams of deionized water in a glass kettle and were homogenized using IKA Ultra Turrax T50 homogenizer operating at 4000 rpm for about 1 minutes.

Thereafter, about 1.79 grams of $Al_2(SO_4)_3$ mixed with about 48 grams of deionized water as a flocculent was added drop-wise to the kettle and homogenized for about 10 minutes with mixing at about 4000 rpm. The mixture was degassed for about 20 minutes with mixing at about 280 rpm and then was heated at a rate of about 1° C. per minute to a temperature of about 52° C. with stirring at about 360 rpm for aggregation. The particle size was monitored using a Coulter Counter until the particle size reached about 5 μm.

The shell mixture of Example 2, including about 35.7 grams of the polyalkoxylated bisphenol A-co-terephthalic acid/dodecenylsuccinic acid/trimellitic acid resin from Kao resin in an emulsion described above, about 39.9 grams of the polyalkoxylated bisphenol A-co-terephthalic acid/fumaric acid/dodecenylsuccinic acid resin from Kao in an emulsion described above, about 1.2 grams of DOWFAX™ 2A1, and about 36 grams of deionized water, were introduced into the reaction vessel and the particles allowed to aggregate for from about another 10 minutes to about 20 minutes at about 40° C., with mixing at about 400 rpm.

Once the volume average particle diameter was above about 5.7 μm according to the measurement with a Coulter Counter, the pH of the aggregation slurry was adjusted to about 4 by the addition of about 4% by weight of NaOH solution, followed by the addition of about 3.1 grams of EDTA and thereafter decreased the mixing speed to about 190 rpm to freeze the toner aggregation at a pH of about 7.8, which was maintained by the addition of about 4% by weight of the NaOH solution.

After freezing, the toner slurry was heated to coalesce. The resulting toner had a final particle size of about 5.53 μm, a GSD v/n of about 1.22/1.23, and a circularity of about 0.971. The toner slurry was then cooled to room temperature, separated by sieving (using a 25 μm sieve), and filtered, which was followed by washing and freeze drying.

The resulting toner particles had about 20% by weight of titanium dioxide pigment.

Example 5

Another toner was prepared following the same synthesis described in Example 4 above, except that 152 grams of the titanium dioxide dispersion from Example 1 was used for aggregation. The resulting toner had a final particle size of about 6.27 μm, a GSD v/n of about 1.27/1.26, and a circularity of about 0.957.

The resulting toner particles had about 31% by weight of titanium dioxide pigment. A summary of the toners produced in Examples 2-5 above is set forth below in Table 1.

TABLE 1

| | TiO2 wt % | TGA Residue % | GSD v | Circularity |
|---|---|---|---|---|
| Example 2 | 0 | 0 | 1.18 | 0.970 |
| Example 3 | 15 | 14 | 1.23 | 0.980 |
| Example 4 | 20 | 18.5 | 1.22 | 0.971 |
| Example 5 | 31 | 29 | 1.27 | 0.957 |

Figure 1B:
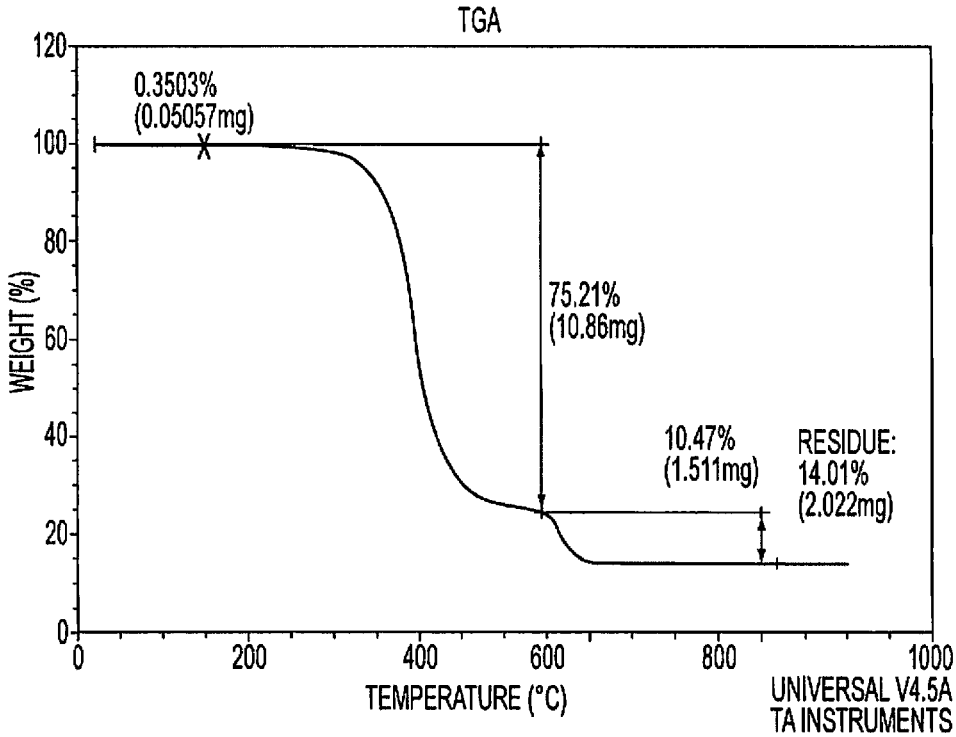
FIG. 1B is a graph showing the results of a thermogravimetric analysis of a toner of Example 3 of the present disclosure as a function of weight versus time.
Figure 1C:
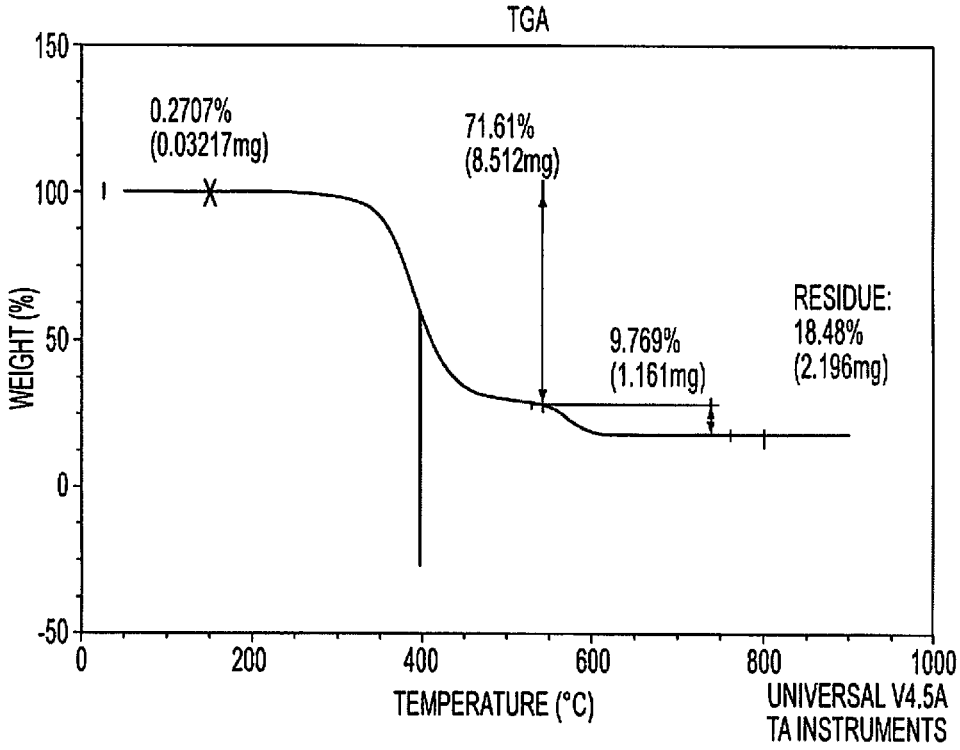
FIG. 1C is a graph showing the results of a thermogravimetric analysis of a toner of Example 4 of the present disclosure as a function of weight versus time.
Figure 1D:
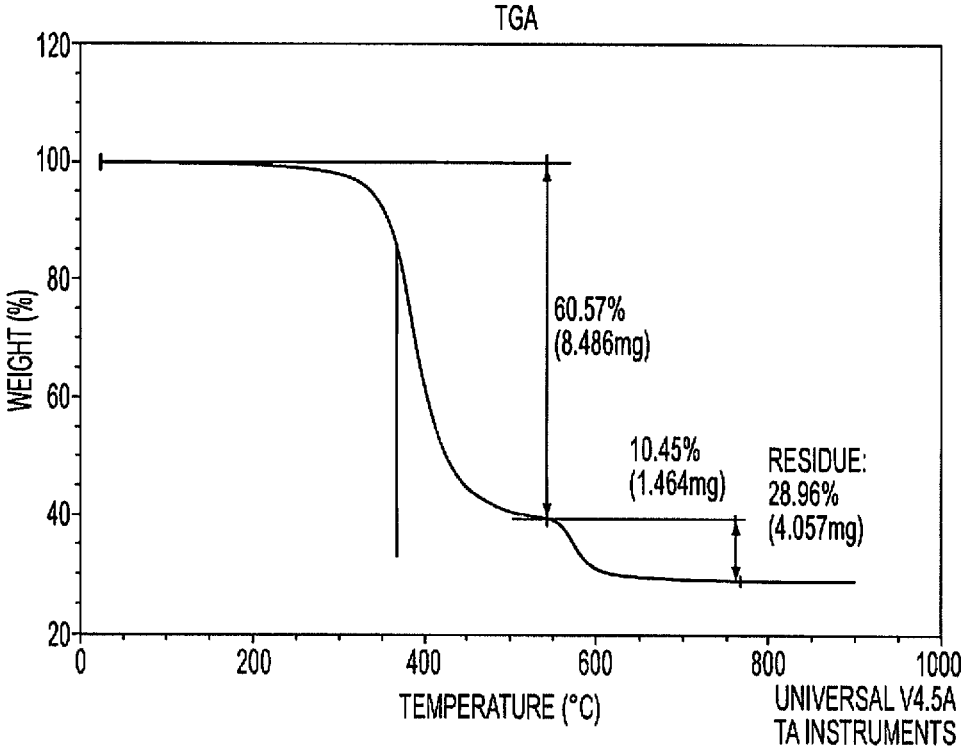
FIG. 1D is a graph showing the results of a thermogravimetric analysis of a toner of Example 5 of the present disclosure as a function of weight versus time.

TGA = thermogravemetric analysis measurement utilized to determine titanium dioxide residue TGA measurements to determine the amount of titanium dioxide in the toner particles were conducted using a TGA Q5000 from TA Instruments. In addition to Table 1 above, the Figures include graphs showing the measurements, which indicate the successful addition of titanium dioxide into the ULM toner. The variations of the data are all within acceptable levels of experimental uncertainty. FIG. 1A is a graph of the TGA results for the toner of Example 2 (no titanium dioxide); FIG. 1B is a graph of the TGA results for the toner of Example 3 (15% titanium dioxide—residue was 14%); FIG. 1C is a graph of the TGA results for the toner of Example 4 (20% titanium dioxide—residue was 18.5%); and FIG. 1D is a graph of the TGA results for the toner of Example 5 (31% titanium dioxide—residue was 29%).

Wet-deposition combined with image transfer techniques were conducted for an easy and quick characterization of the white toners of the Examples. More particularly, for the toners produced above according to the Examples, transferred images on glossy black and/or mylar substrates were prepared combining wet deposition and lamination. In the first step of the process, a wet deposition sample was applied face down to either a glossy black or mylar substrate. The sample was then passed through a laminator at a temperature of about 70° C., at a rate of about 12 mm/second, to enable 100% of the transfer of the image. The image gave a matte appearance (having a gloss of about 5 ggu) because the toner was not fused. The transferred image was then passed through another laminator at a temperature of about 100° C. at a rate of about 6.96 mm/minute to complete fusing, after which a glossy image was obtained, (having a gloss of about 80 ggu).

The transferred images were subjected to color analysis. The transferred images on the glossy black or mylar substrates were analyzed for L*a*b*, i.e., the L*a*b* dimension of color space, using a Gretag Macbeth Spectrolino colorimeter, operating at a 2 degree of visual field with a light source D50. The color space of a white toner image is conventionally featured as lightness L*>about 75, in embodiments from about 70 to about 99, in other embodiments from about 75 to about 98, a redness a* from about −5 to about 5, and a yellowness b* from about −7 to about 7 (TMA is from about 0.45 mg/cm$^2$ to about 3 mg/cm$^2$) on a black substrate having a color space with L* from about 3 to about 6, a* from about −5 to about 5, and b* from about −10 to about 10. The L*a*b* coordinates for the toners of the present disclosure are set forth in Table 2 below.

TABLE 2

Summary of Toner L*a*b*

| | TIO2 wt % | Substrate | TMA | L* | a* | b* |
|---|---|---|---|---|---|---|
| Example 2 | 0 | Black | 2.0 | 5.12 | −0.15 | −0.02 |
| Example 3 | 15 | Mylar | 1.0 | 72.64 | −3.15 | −5.99 |
| Example 3 | 15 | Black | 2.0 | 74.79 | −2.83 | −4.88 |
| Example 3 | 15 | Black | 3.0 | 80.88 | −2.55 | −3.21 |
| Example 4 | 20 | Mylar | 1.0 | 75.69 | −2.98 | −5.42 |
| Example 4 | 20 | Black | 2.0 | 78.51 | −2.63 | −4.35 |
| Example 4 | 20 | Black | 3.0 | 83.87 | −2.34 | −2.7 |
| Example 5 | 31 | Mylar | 1.0 | 79.61 | −2.37 | −4.41 |
| Example 5 | 31 | Black | 2.0 | 81.98 | −2.73 | −3.75 |
| Example 5 | 31 | Black | 3.0 | 86.73 | −2 | −1.99 |

Figure 2:
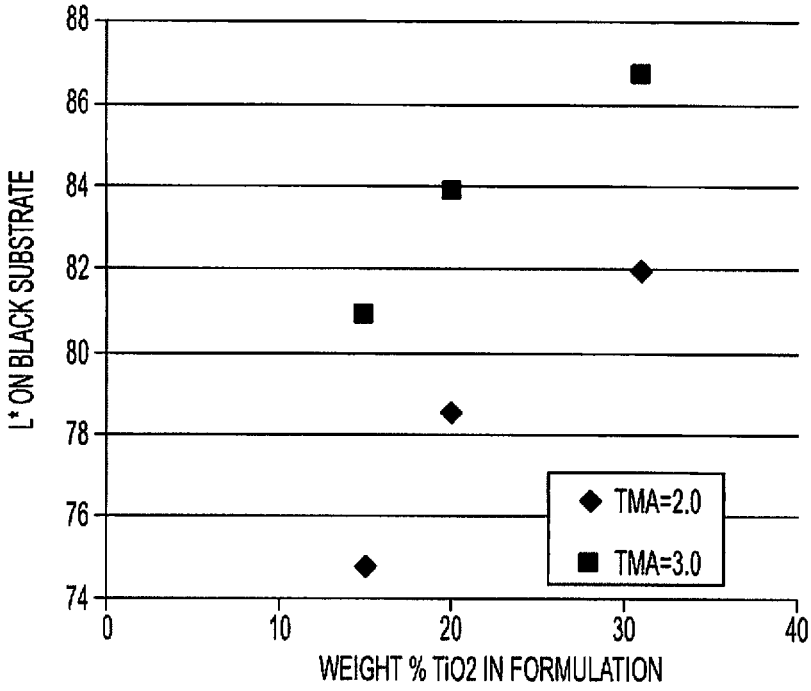
FIG. 2 is a graph showing the L* (lightness) for a toner of the present disclosure on a glossy black substrate as a function of weight of titanium dioxide.

FIG. 2 is a graph showing the L* on the glossy black substrate versus weight % TiO2 in the toner formulations. As can be seen in FIG. 2, as the $TiO_2$ and TMA increased, the L* increased.

Figure 3:
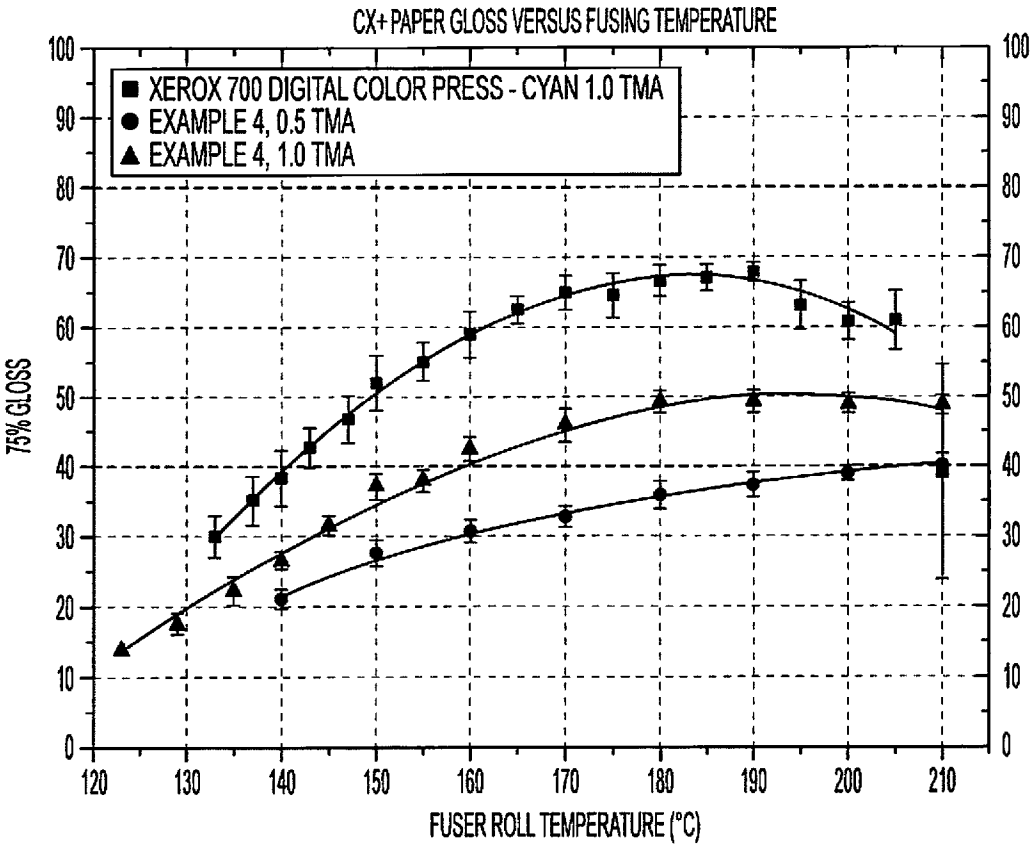
FIG. 3 is a graph showing the gloss results for toners of the present disclosure versus a control.

Printing tests were conducted as follows. Samples from Example 4 were fused to determine the initial fusing performance of the titanium dioxide containing toners. For this scoping activity, the oil-less color fuser in a Patriot fuser (from a Xerox DC250 printer) was used as the test fixture. Unfused images were generated using a Xerox DocuColor 12 printer at about 0.5 mg/cm$^2$ and 1 mg/cm$^2$ toner mass per unit area onto an uncoated paper, Color Xpressions+ (about 90 gsm) (from Xerox), as well as coated paper, Digital Color Elite gloss (about 120 gsm) (from Xerox) before being run through the fuser. Process speed of the fuser was set to about 220 mm/second and the fuser roll temperature was varied from gloss offset to where hot offset occurred. Print gloss of the fused prints was then measured using a BYK Gardner 75° gloss meter. A summary of the gloss results is shown in FIG. 3.

Figure 4A:
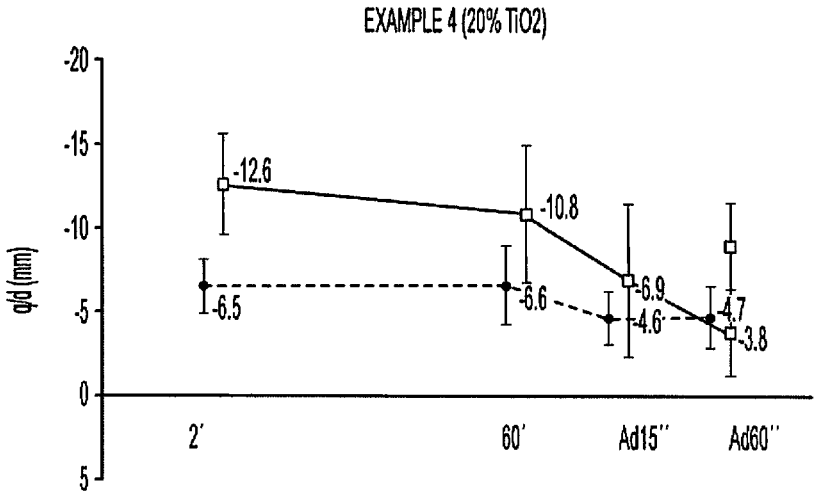
FIG. 4A is a graph showing charging performance of a toner of the present disclosure.
Figure 4B:
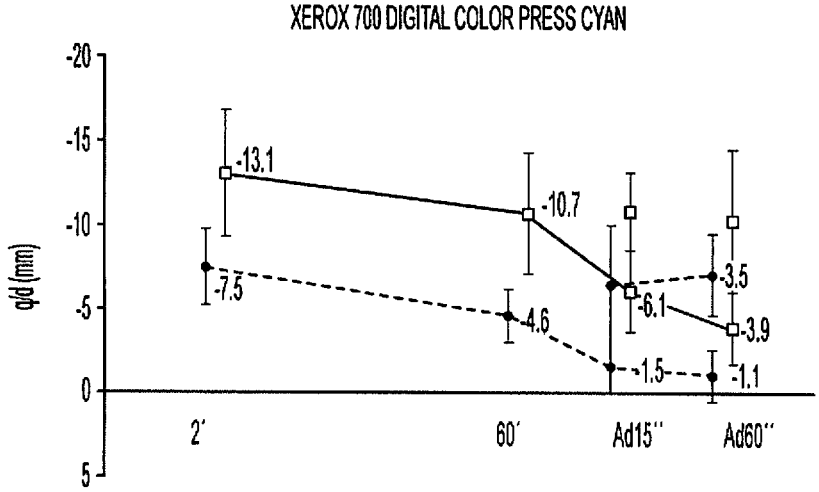
FIG. 4B is a graph showing charging performance of a control cyan toner.

Bench developer charging results were also obtained for the toner of Example 4 (20% titanium dioxide); the results are set forth in FIGS. 4A-4B. Briefly, the charging test was conducted as follows. Each toner sample was blended on a sample mill for about 30 seconds at about 15000 rpm. Developer samples were prepared with about 0.5 grams of the toner sample and about 10 grams of a Xerox 700 digital Color Press carrier. A duplicate developer sample pair was prepared for each toner that was evaluated. One developer of the pair was conditioned overnight in A-zone (28° C./85% RH), and the other was conditioned overnight in the C-zone environmental chamber (10° C./15% RH).

The next day, the developer samples were sealed and agitated for about 2 minutes and then for about 58 minutes using a Turbula mixer. After about 2 minutes and about 58 minutes of mixing, the triboelectric charge of the toner was measured using a charge spectrograph using a 100 V/cm field. The toner charge (q/d) was measured visually as the midpoint of the toner charge distribution. The charge was reported in millimeters of displacement from the zero line. Following about 1 hour of mixing, an additional 0.5 grams of toner sample was added to the already charged developer, and mixed for a further 15 seconds, where a q/d displacement was again measured, and then mixed for a further 45 seconds (total about 1 minute of mixing), and again a q/d displacement was measured.

Charging of the final toners was measured with a Xerox 700 digital Color Press carrier, and an additive package consisting of 0.88% titanium dioxide, 1.71% PDMS-surface treated silica, 1.73% sol-gel silica, 0.55% perfluoropolyether, 0.9% polymeric alcohol. Overall charging performance of the white toner was better than a commercially available cyan toner from the Xerox 700 Digital Color Press. As can be seen from FIGS. 4A-4B, the toners of the present disclosure had a very stable A-zone charge, and an increase in charge level resulted in better RH sensitivity. FIG. 4A shows the charging of example 4 toner, whereas FIG. 4B shows the charging results of a Xerox 700 Digital Color Press cyan toner. Thus, the bench charging evaluation of the white toner suggested improved performance over the commercially available cyan control.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A toner comprising:

at least one resin; and at least one colorant comprising titanium dioxide that has been subjected to an alumina surface treatment and that contains alumina, said titanium dioxide further having an oil absorption of from 10 to 25 pounds of oil per 100 pounds of titanium dioxide, said titanium dioxide having a specific gravity of from 3.6 to 4.4, wherein the toner has a gloss of from 15 ggu to 70 ggu;

wherein the toner is an emulsion aggregation toner having a volume average particle diameter of from 4 to 15 microns and a number average geometric size distribution of less than 1.31.

2. A toner according to claim 1, wherein the titanium dioxide comprises rutile titanium dioxide.

3. A toner according to claim 1, wherein the titanium dioxide is present in an amount of from 15 weight percent to 35 weight percent of the toner.

4. A toner according to claim 1, wherein the titanium dioxide contains silica.

5. A toner according to claim 4, wherein the silica is present in an amount from 1 to 4 percent by weight of the colorant and the titanium dioxide is present in an amount from 90 to 99.9 percent by weight of the colorant.

6. A toner according to claim 1, wherein the titanium dioxide has a size of from 120 nm to 600 nm.

7. A toner according to claim 1, wherein the titanium dioxide has a specific gravity from 3.8 to 4.2.

8. A toner according to claim 1, wherein the titanium dioxide has a lightness L* from 95 to 100.

9. A toner according to claim 1, wherein the titanium dioxide has a pH from 7 to 9.

10. A toner according to claim 1, wherein the at least one resin is selected from the group consisting of amorphous polyester resins, crystalline polyester resins, and combinations thereof.

11. A toner according to claim 10, wherein the amorphous resin is a polyalkoxylated bisphenol A-co-terephthalic acid/dodecenylsuccinic acid/trimellitic acid or a polyalkoxylated bisphenol A-co-terephthalic acid/fumaric acid/dodecenylsuccinic acid resin or a combination thereof, and wherein the crystalline resin is a polydodecanedioic acid-co-1,9-nonanediol crystalline polyester resin.

12. A toner according to claim 10, wherein the amorphous resin has a weight average molecular weight of from 10,000 to 100,000, and the crystalline resin has a weight average molecular weight of from 10,000 to 100,000.

13. A toner according to claim 1, further comprising a wax.

14. A toner according to 13, wherein the wax is selected from the group consisting of polyolefins, carnauba wax, rice wax, candelilla wax, sumacs wax, jojoba oil, beeswax, montan wax, ozokerite, ceresin, paraffin wax, microcrystalline wax, Fischer-Tropsch wax, stearyl stearate, behenyl behenate, butyl stearate, propyl oleate, glyceride monostearate, glyceride distearate, pentaerythritol tetra behenate, diethyleneglycol monostearate, dipropyleneglycol distearate, diglyceryl distearate, triglyceryl tetrastearate, sorbitan monostearate, cholesteryl stearate, and combinations thereof, present in an amount from 1 weight percent to 25 weight percent of the toner.

15. An image formed with a toner of claim 1 on a black substrate, the image having a lightness L* of greater than 75, a redness a* of from −5 to 5, and a yellowness b* of from about −7 to 7.

16. A white toner comprising:

at least one polyester resin;

at least one colorant comprising rutile titanium dioxide that has been subjected to an alumina surface treatment, and that contains silica and alumina, said titanium dioxide having an oil absorption of from 15 to 20 pounds of oil per 100 pounds of titanium dioxide, said titanium dioxide having a specific gravity of from 3.8 to 4.2, wherein the silica is present in an amount from 1 to 4 percent by weight of the colorant and the titanium dioxide is present in an amount from 90 to 99.9 percent by weight of the colorant, and wherein the toner has a gloss of from 15 ggu to 70 ggu;

wherein the toner is an emulsion aggregation toner having a volume average particle diameter of from 4 to 15 microns, a number average geometric size distribution of less than 1.31, and a circularity of from 0.92 to 0.99.

17. A toner according to claim 16, wherein the rutile titanium dioxide has a size of from 120 nm to 500 nm, and wherein the rutile titanium dioxide is present in an amount of from 15 weight percent to 35 weight percent of the toner.

18. A toner according to claim 16, wherein the at least one polyester resin is selected from the group consisting of amorphous polyester resins having a weight average molecular weight of from 10,000 to 100,000, crystalline polyester resins having a weight average molecular weight of from 10,000 to 100,000, and combinations thereof.

19. A toner according to claim 18, wherein the amorphous resin is a polyalkoxylated bisphenol A-co-terephthalic acid/ dodecenylsuccinic acid/trimellitic acid or a polyalkoxylated bisphenol A-co-terephthalic acid/fumaric acid/dodecenylsuccinic acid resin or a combination thereof, and wherein the crystalline resin is a polydodecanedioic acid-co-1,9-nonanediol crystalline polyester resin.

* * * * *